United States Patent [19]

Warne

[11] 4,292,149

[45] Sep. 29, 1981

[54] CURRENT ROPE ANODES

[75] Inventor: Michael A. Warne, Brewood, England

[73] Assignee: IMI Marston Limited, Wolverhampton, England

[21] Appl. No.: 110,453

[22] Filed: Jan. 8, 1980

[30] Foreign Application Priority Data

Jan. 19, 1979 [GB] United Kingdom ..... 02086/79

[51] Int. Cl.[3] ..... C23F 13/00

[52] U.S. Cl. ..... 204/147; 204/196

[58] Field of Search ..... 204/147, 148, 196, 197

[56] References Cited

U.S. PATENT DOCUMENTS

| | | | |
|---|---|---|---|
| 2,508,171 | 5/1950 | Kaufman | 204/197 |
| 2,870,079 | 1/1959 | McCall | 204/197 |
| 2,908,623 | 10/1959 | Doring | 204/196 |
| 2,996,445 | 8/1961 | Eisenberg et al. | 204/196 |
| 3,022,242 | 2/1962 | Anderson | 204/196 |
| 3,037,926 | 6/1962 | Ambler | 204/197 |
| 3,133,872 | 5/1964 | Miller et al. | 204/196 |
| 3,135,677 | 6/1964 | Fischer | 204/196 |
| 3,196,101 | 7/1965 | Hosford | 204/197 |
| 3,409,530 | 11/1968 | Locke et al. | 204/196 |
| 3,445,370 | 5/1969 | Sherman | 204/197 |
| 3,497,443 | 2/1970 | von Bursdorff | 204/196 |
| 3,562,130 | 2/1971 | Hoole et al. | 204/195 M |
| 3,616,418 | 10/1971 | Anderson et al. | 204/196 |
| 3,708,411 | 1/1973 | Vanslette | 204/195 M |

*Primary Examiner*—T. M. Tufariello

*Attorney, Agent, or Firm*—Cushman, Darby & Cushman

[57] ABSTRACT

The invention provides a submergeable structure provided with cathodic protection means comprising a flexible impressed current anode assembly including at least one elongate electrode wound around a rope and lying in the depressions between the strands of the rope to provide an anodic region and rope extensions extending from the anodic region in at least two different directions, said extensions being secured to the structure so as to space the anodic region from metal of the structure to be protected. In addition, the invention includes an impressed current anode assembly suitable for use as the above defined cathodic protection means and having an anodic region comprising an elongate electrode wound around an insulating rope which passes through the anodic region and extends therefrom in at least two different directions.

A particularly useful anode assembly in accordance with the invention includes platinized titanium or niobium wire (preferably copper-cored) for the electrode(s) helically wound around a rope of polyester or polypropylene. Regardless of the structure of the anode assembly, a plurality of assemblies in accordance with the invention may be assembled using a harness system to provide an impressed current anode system for cathodic protection of a submerged structure.

The invention also relates to a new design of reference electrode which may be used with the anode assembly of the invention.

The invention has particular utility in cathodic protection of oil rigs.

15 Claims, 13 Drawing Figures

CURRENT ROPE ANODES

BACKGROUND OF THE INVENTION

This invention relates to cathodic protection anode assemblies which are suitable for cathodic protection of marine, and other submergeable, structures. The invention also provides a new reference electrode, methods of cathodically protecting structures and structures so protected.

Cathodic protection is the chief line of defence for corrosion control of steel structures in a marine environment. Whilst sacrificial anodes may be used for this purpose, the design lives of 25 to 30 years which have been specified as the theoretical maxima for such anodes are open to doubt. Sacrificial anodes do, of course, have the advantage that they provide immediate protection of the structure when submerged. Impressed current systems for cathodic protection require a DC power supply, and there may be considerable delay due to other constraints in providing this effectively in an offshore structure. Furthermore, existing impressed current systems are based on long life anodes with heavy coatings of platinum on, for example, a substrate of niobium. Such anodes are extremely expensive.

It will be apparent that in many circumstances, the provision of a relatively short to medium life system would have considerable advantages (say from 3 to 10 years in expected lifetime). Such an impressed current anode system should be relatively cheap and easy to install. All impressed current anodes have the great advantage that their output and effectiveness can be monitored and they are extremely easy to control.

DESCRIPTION OF THE PRIOR ART

Temporary anode assemblies of the type which can be suspended between the legs of an oil rig are described in British Pat. No. 1,299,989. In that specification there is described an anode assembly comprising a cable which is connected at its ends to the legs of a steel structure to be cathodically protected. In the central region the cable is provided with a thickened sheath of an insulating material around which is wound a conducting cable carrying elongated anodes. In order to effect uniform current distribution the anodic portion of the cable assembly is said to comprise approximately the central third of the overall length of the anode and cable assembly so that the anodic region can be supported between the legs of a structure to be protected and provide adequate throwing power and uniform current distribution to the structure.

In U.S. Pat. No. 3,037,926 there is described the provision of a sacrificial anode assembly wherein the anodes are suspended from a chain or cable which is connected at either end to a metal structure to be protected.

There is also described, in U.S. Pat. No. 3,497,443, an internal anode for the cathodic rust protection of pipelines in which an anode assembly is provided in which an insulated conductor is wound in a wide spiral continuously around the entire length of an anode wire.

U.S. Pat. No. 2,870,079 describes the use of a consumable anode in which the anode is suspended between the legs of a structure to be protected by means of an elongated chain.

It is an object of the present invention to provide an anode assembly which, when compared to the prior art anode assemblies of the type described above, is flexible and can be coiled around relatively small diameter drums, which is a natural eddy shedder and which would be handled without serious risk of damage to the anode member.

SUMMARY OF THE INVENTION

By the present invention there is provided a cathodic protection anode assembly comprising a rope having two or more strands helically wound around one another, at least one anodically polarisable material in the form of an elongate member wound helically around the rope and lying in a depression between the strands, the elongate member being electrically insulated from the rope, there being provided means to connect, in use, the anodically polarisable material to a source of electrical current.

There may be three or more strands. There may be a plurality of elongate anodically polarisable members. The rope may be formed of electrically insulating material. The rope may be provided with at least one shrink-fit plastics material sheath, the sheath being shrunk onto the rope and the elongate member or members being disposed around the rope over the sheath.

The sheath may be formed of a material resistant to gases generated, in use, at the anodically active elongate material and may preferably be formed of polyvinylidene fluoride.

The elongate member may be formed of titanium, niobium or tantalum with a coating of an anodically active material. The anodically active material may be chosen from the group platinum, iridium, palladium, ruthenium, rhodium or osmium or alloys thereof or oxides or other anodically active compounds thereof.

The elongate members may be formed of platinised titanium copper cored wire.

The strands of the rope may be formed from a polyester material or from polypropylene.

The elongate members may be held in place by further shrink-fit sleeves of plastics material.

The rope may have a central portion around which the elongate members are wound and two integral end portions wherein the length of each of the end portions is not less than the length of the central portion.

The present invention further provides a method of cathodically protecting a structure comprising the steps of securing to the structure a cathodic protection anode assembly as hereinabove described. The anodically polarisable material may be connected as an anode relative to the structure and an electrical current passed therethrough. The present invention further provides a structure when cathodically protected by the anode assembly as hereinabove described.

By the term "rope" as used herein we mean a material which is elongated formed from two or more strands twisted around one another and which is resistant to corrosion, rot proof and has load-bearing capability.

Polypropylene or polyester ropes are highly suitable materials for use in ropes in the present invention and a typical polypropylene rope for use in the present invention has a diameter of 20 mm. Such ropes, being insulating ropes, are, of course, particularly suitable for use in the above-defined anode assembly. Metal ropes can be used in those embodiments where the rope need not be insulating, although such ropes must, of course, be insulated from the metal structure being protected and from the anode itself. The invention includes structures provided with anode assemblies (and, indeed, the assemblies themselves) wherein the rope is totally insulating, totally electrically conductive, or part of the rope is insulating and part is electrically conductive.

By way of example, some form of insulated current feeder can be used as one of the rope extensions—the extension then having the dual functions of supporting and assisting in positioning the anodic region and of supplying current thereto. In the above-defined anode assembly, which incorporates an insulating rope passing through the anodic region, the elongate electrode must be selected from a material which is sufficiently electrically conductive to allow for adequate current for satisfactory cathodic protection with a modest voltage.

By "anodically polarisable material" as used herein is meant a material which, when connected as an anode in an electrolyte such as seawater, will continue to pass electrical current whilst being substantially unaltered and not dissolving at any significant rate.

It will be appreciated that (as will be indicated in more detail later in connection with a specific embodiment of the invention to be described with reference to the accompanying drawings) the above-defined anode assembly involving a relatively lightweight rope and a long lightweight electrode wound therearound has several considerable practical advantages.

The invention provides a number of advantages over the prior art described above. Firstly, by mounting the thin elongate members in the depressions formed between the strands of the rope the rope remains flexible and may be coiled about relatively small diameter drums. Thus, the coiling diameter of a 20 mm diameter rope having three strands and being provided with three elongate members is 1 mm. Furthermore, the fact that the elongate members are recessed in the depression means that the rope can be dragged over edges such as are frequently found on boats and ships without the elongate members being damaged, without the elongate members becoming detached from the rope and without the elongate members concertinaing up the rope as might happen if they were to be caught by the edge.

The provision of a helical rope with helically wound elongate members such that the rope retains its helical shape and appearance also means that the rope remains a natural eddy shedder when installed in moving water. Perfectly cylindrical ropes tend to create eddies which can cause the ropes to vibrate and eventually fail by fatigue. Because the present invention provides a naturally helical structure the eddies are shed from the rope and the rope does not vibrate and hence does not, therefore, fatigue.

The use of thin elongate members has also electrical advantages insofar as the preferred three elongate members behave as a large diameter anode with good electrical throwing power whilst consuming only relatively small quantities of expensive materials.

The present invention is extremely flexible in that a "tailor-made" cathodic protection system can be designed for any particular structure to be protected and the system can be used as a "retrofit" installation to provide protection for a structure which is already suffering corrosion attack. Thus, for example, a number of rope anode assemblies in accordance with the present invention can be strung at each level in an offshore oil rig to provide, at each level, a distributed overall anodic system to which a suitable current can be applied.

A number of the anode assemblies of the present invention together with any associates cables (if desired) and/or with suspensions can be made up and coiled onto a drum to ease transport and handling on site at sea or elsewhere.

The preferred structure for the anode assembly of the present invention is a polyester or polypropylene rope having wound around it three copper-cored plantinised titanium wires of, for example, 4 mm diameter, spirally wound round the rope conforming to the pitch of the rope. The rope may be protected from degradation products produced electrolytically at the anode surface by covering the rope with a protective layer, eg heat shrink sleeving such as the material sold under the trade name "Kynar". The same material may also be used to attach the electrodes to the rope at periodic intervals by providing a series of spaced external Kynar sleeves around the electrode windings along the overall rope structure. Kynar is a polyvinylidene fluoride material.

With the structure as described above, power connections may be effected by means of flexible insulated conductors similar to welding cable. Electrical cable connection may be made at one end of the anode in such a manner that seawater dissolution products do not contaminate the connection. Furthermore, the anchoring arrangements (which obviously depend upon the structure which it is desired to protect) at each end of the rope may be fabricated from non-metallic material except where bolts are required.

It is important to appreciate that in the present invention the length of the rope and the suspension arrangements for the entire structure are unrelated to the length of the electrodes and may be designed to suit the particular application. A harness system may be designed for a number of such structures to provide protection for a sizeable structure.

Using the preferred titanium-based rope anode assembly described above it has been calculated that the maximum economical output in natural sea water is about 250 amps per anode. With this structure, if the anodic region on the rope is longer than 10 m a reduced output per unit length is obtained and a significant voltage drop occurs making such longer anodic regions undesirable. It is also not desirable (for the reason described above) to have the anodic region closer to the steel structure being protected than 10 m or so. In practical terms it is believed that from 12 to 18 m length of the platinised titanium wire is desirable to provide (in wound form) the 10 m anodic region length, more preferably from 12 to 14 m of platinised titanium wire. In practice, from 5 to 15 volts are applied to the anodes.

Reference has been made above to the use of "Kynar" as the material for heat shrink sleeving to protect the rope and to hold the electrode windings to the rope. This material is highly desirable because of its extreme chemical inertness. However, it should be noted that each of the anode wires where they emerge at the ends of the, for example, 10 m, anodic region length may be protected by heat shrink sleeving (eg "Atum" shrink fit sleeve manufactured by Raychem Limited—"Atum" is polyolefine heat shrinkable outer with a meltable core) or the ends of the anode wires may be sealed with titanium.

Suspension of an anode assembly in accordance with the present invention may be achieved by using eyes at each end of the rope and utilising standard rope and webbing slings at anchor points. A preload may be applied to the assembly during installation to restrain excessive movement during storms (particularly important with offshore structures).

An anode assembly in accordance with the present invention may be suspended through a tube positioned amongst the members of a structure which it is desired to protect, eg an oil rig, a rope extension of the anode assembly being positioned through the tube and secured to the structure at one end of the tube whilst the anodic region of the anode assembly is outside the tube at the other end thereof and a second rope extension being fastened to another portion of the structure. With such a design, cables which are needed may be led to upper levels of the structure being protected through the tube. The tube may be provided, at the end thereof adjacent the anodic region of the anode assembly, with a bell fitting to facilitate positioning of the anode assembly therethrough. Suitable tubes which can be used with the anode assemblies of the present invention are sometimes found in cathodically protected structures which employ more conventional fixed anodes rather than the flexible anodes of the present invention.

It will be appreciated that whilst the present invention is highly suitable for cathodic protection of oil rigs and the like, the invention has extremely wide applicability where protection of submerged structures is desired and, indeed, it is the extreme flexibility of the present system in comparison to most prior art systems that provides the major advantage of the present invention.

The present invention also provides an impressed current cathodic protection system which comprises a plurality of anode assemblies in accordance with the invention prefabricated into a harness. A suitable number of anode assemblies in accordance with the invention for incorporation into a harness is from 3 to 10, eg 5 or 6.

BRIEF DESCRIPTION OF THE DRAWINGS

The invention will now be further described and illustrated by reference to the accompanying drawings, in which.

DESCRIPTION OF THE PREFERRED EMBODIMENTS

Figure 1:
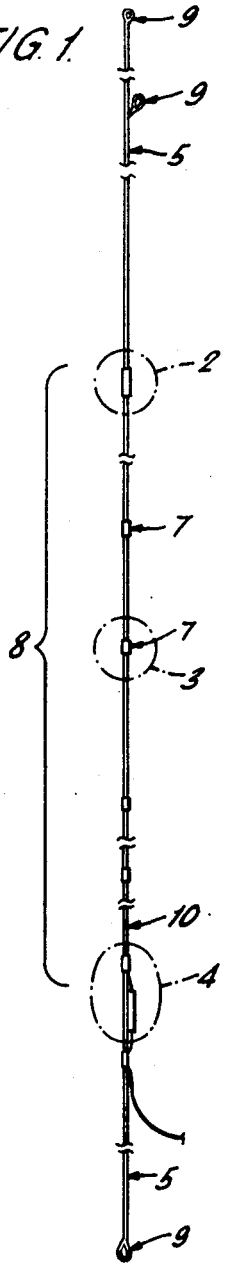
FIG. 1 shows a diagrammatic overall view of an anode assembly in accordance with the present invention.

Turning first to FIG. 1 of the drawings, it will be seen that the specific anode assembly shown comprises a rope 5 made of polypropylene fibre and protected by a Kynar heat shrink sleeve. The rope is suitably of 20 mm diameter. Rope 5 (shown for reasons of clarity without its strands) has electrode windings 6 (FIGS. 2 and 3) consisting of 4 mm diameter copper-cored platinised titanium wires wound therearound. There are three such platinised titanium wires wound helically around rope 5.

At periodic intervals rope 5 is provided with a shrink fit sleeve 7 of Kynar to secure the electrode windings 6 to rope 5. A further Kynar sleeve is provided to an end 2 of the overall electrode (anodic) region (designated generally by reference numeral 8) which is remote from the electrical cable connection to the electrode region (itself designated generally by reference numeral 4).

Eyes 9 are provided at the ends of rope 5 for securing the anode assembly to the structure which it is desired to protect. It will be noted that an additional eye is fitted to the rope 5 at the end thereof which is remote from electrical cable connection 4 in order to facilitate tensioning and diver installation of the anode assembly. The rope is preferably provided with a preload of between one half and one ton during installation to prevent excessive movement thereof after installation and during storms.

Figure 2:
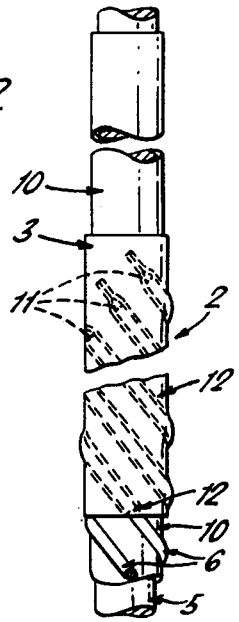
FIG. 2 shows the detail of the termination of the electrode windings in the anode assembly of FIG. 1.

FIG. 2 of the drawings, as already indicated, shows the end of the electrode region designated 2 in FIG. 1. It will be seen that rope 5 is protected by Kynar sleeving 10 from electrode windings 6. The ends of the electrodes 11 are sealed in Atum heat shrink sleeving 12 (available from Raychem Limited), although titanium sealing may alternatively be used. The ends 11 are covered by further Kynar sleeving 13.

Figure 3:
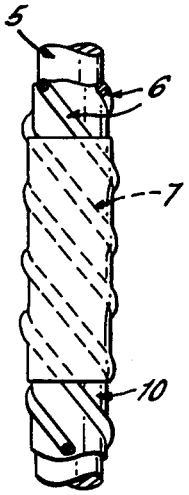
FIG. 3 shows detail of an intermediate section of the electrode windings of the anode assembly of FIG. 1.

Turning to FIG. 3, it can be seen that electrode windings 6 are covered by further Kynar sleeving 7 and thereby held in place on Kynar sleeving 10 which covers rope 5.

Figure 4A:
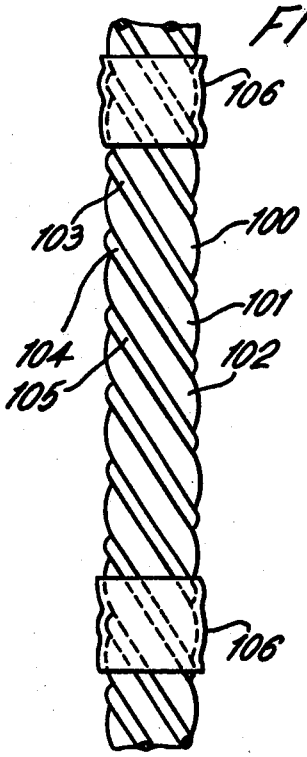
FIGS. 4*a*, 4*b*, 4*c* and 4*d* show details of the rope and electrode windings of FIG. 3.

FIGS. 4*a* to 4*d* show in more detail the location of the electrode windings on the rope. FIG. 4*a* illustrates a three-start rope which has the three strands 100, 101, 102 helically wound around one another. Wound into the depressions between the strands are three substantially parallel elongate wires 103, 104, 105. The three elongate wires are formed of copper-cored titanium with a platinised surface and are in use electrically connected to be the anodes. The wires are held in place by heat shrunk Kynar sheaths 106 which are located along the length of the rope.

Figure 4B:
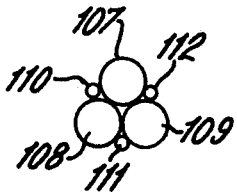

As shown in FIG. 4*b* the three strands 107, 108, 109 define between them three depressions in which the three titanium elongate members 110, 111, 112 lie.

Figure 4C:
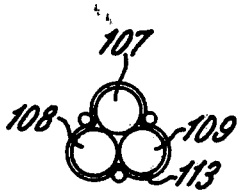

Normally the strands would be covered with a layer of Kynar sheath as is shown in FIG. 4*c*. The sheath 113 goes all round the strands 107, 108, 109.

Figure 4D:
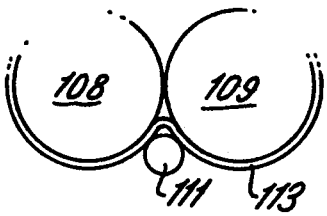

In more detail, as is shown in FIG. 4*d*, the sheath 113 shrinks into the depressions between the strands 108, 109 so that the anode wire 111 can still be recessed into the depression of the rope.

Figure 5A:
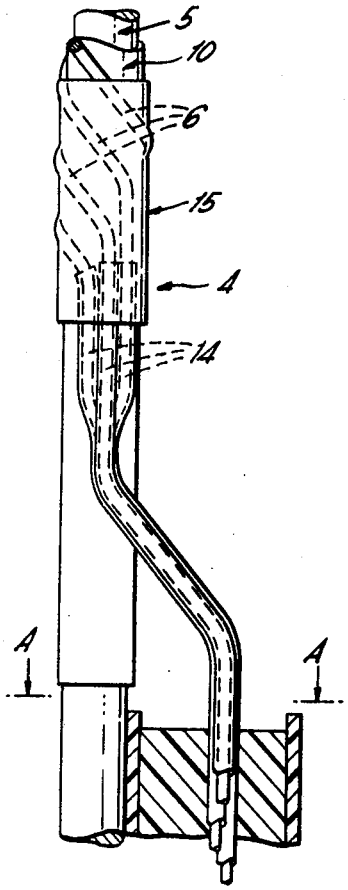
FIGS. 5*a* and 5*b* show the detail of one method of making an electrical cable connection to the electrode windings of the anode assembly of FIG. 1.
Figure 6:
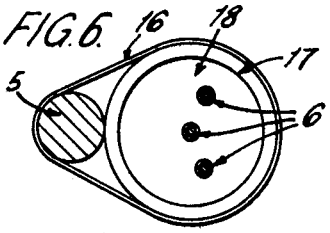
FIG. 6 shows a cross-section through FIG. 5*a*, at line A—A.
Figure 5B:
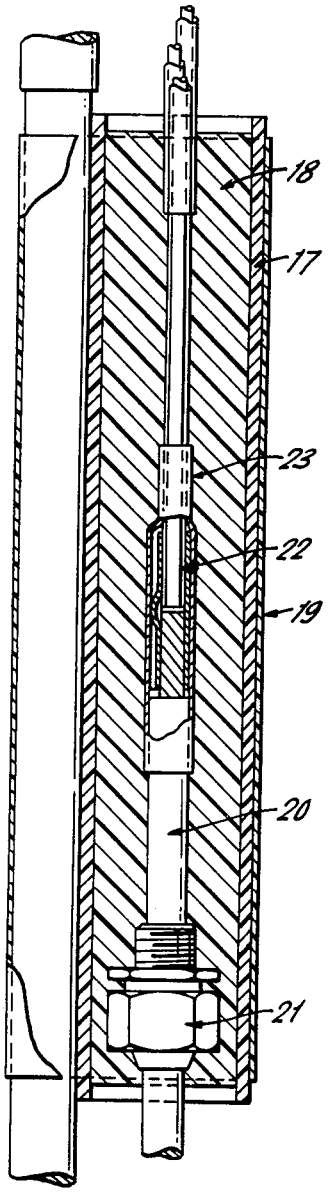

Turning to FIGS. 5*a*, 5*b* and 6 of the drawings, electrode windings 6 at the electrical cable connection 4 end of the anode assembly are provided with coverings of "Atum" heat shrink sleeving 14. Coverings 14 extend just below a Kynar sleeve 15 which holds the electrode windings 6 in place on Kynar sleeve 10 which protects rope 5. The electrode windings 6 pass into a cable/electrode joint assembly which is generally designated by reference numeral 19 and which is secured to rope 5 by further heat shrink sleeving 16. Assembly 19 comprises a polythene tube 17 having an epoxy filling 18 with windings 6 (each being a platinised titanium wire as described above in a heat shrink sleeve) embedded therein. A single core cable 20 leads from a cable gland 21 to a crimp type cable connector 22 to thereby provide electrical connection with the windings 6. Connector 22 is provided with a heat shrink sleeve 23. The single core cable 20 is conveniently of 50 $mm^2$ cross-section and a convenient size for the polythene tube 17 is 50 mm inside diameter and 300 mm length.

The region of the assembly from the Kynar sleeve 15 to just below the top of tube 17 is preferably bound in rubber tape to give protection to the assembly during transit.

Referring again to FIG. 2 of the drawings, an area from just below Kynar sleeve 13 to somewhat further above the same may be protected by means of one or more (eg three) layers of half lapped "Scotch 23" electrical tape, covered overall by a suitably sized heat shrink sleeve. The sleeve 13 is of somewhat greater length than the various sleeves 7 and sleeve 15, preferably about double the length of sleeves 7 and 15. Sleeve 13 may, for example, be 150 mm or so in length and sleeves 7 and 15 may, for example, be 75 mm in length.

It should be noted that protective Kynar sleeve 10 extends from just above the top of tube 17 (FIG. 5*b*) to some way past sleeve 13 at the other end of the electrode region 8. Electrode region 8 is conveniently about 10 m in length and the Kynar sleeving 10 may be, for example, approximately 11½ m in length to thereby totally cover the electrode region 8.

Referring to FIG. 5*b* of the drawings, cable 20 is usually fairly flexible and may be unarmoured and insulated with EPR and sheathed with CSP. It should also be appreciated that an electrical cable connection of the type shown in FIG. 5*b* may be replaced by a simple cable-electrode joint in which a protective jacket (eg vulcanised rubber) is positioned over the joint. Thus, by way of example, an outer protective jacket around the electrical cable may be extended over the end of the electrode to cover the joint.

The anode assembly of the present invention described specifically above with reference to the drawings has the following desirable features for cathodic protection of metallic marine structures (although it may, of course, be used to protect other submerged structures):

(a) the electrode itself is long and thin which not only reduces the necessary "driving" voltage but results in economy of material;

(b) the assembly is flexible and can be coiled and the present invention includes such a coiled structure (or, indeed, a plurality of anode assemblies of the present invention coiled on a drum for use as needed);

(c) provided suitable anchoring arrangements are made, the anode assembly is unlikely to suffer from wear or fatigue in use and is a natural eddy shedder;

(d) The anode assembly typically has a current capacity of up to 250 amps and may be assembled into a harness to provide an overall system for a particular installation with a capacity of, for example, 1,500 amps (ie six anode assemblies);

(e) the minimum theoretical life of a platinum layer is three years and this can be extended as required;

(f) mounting of the anode assembly on a structure which it is desired to protect can be achieved very simply and the direction of hang of the anode assembly may be adapted to suit particular requirements;

(g) because the anode wires can be recessed into the depressions between the strands they are protected from damage caused by abrasion when the rope is pulled over an edge or is pulled along a flat surface.

It will be appreciated that many of the details of the anode assembly described above may be varied depending upon individual requirements and materials available. Thus, alternative means of attaching the electrodes to the rope can be employed other than the use of heat shrink sleeve. However, heat shrink sleeve is a simple and effective means of achieving this end.

Figure 7:
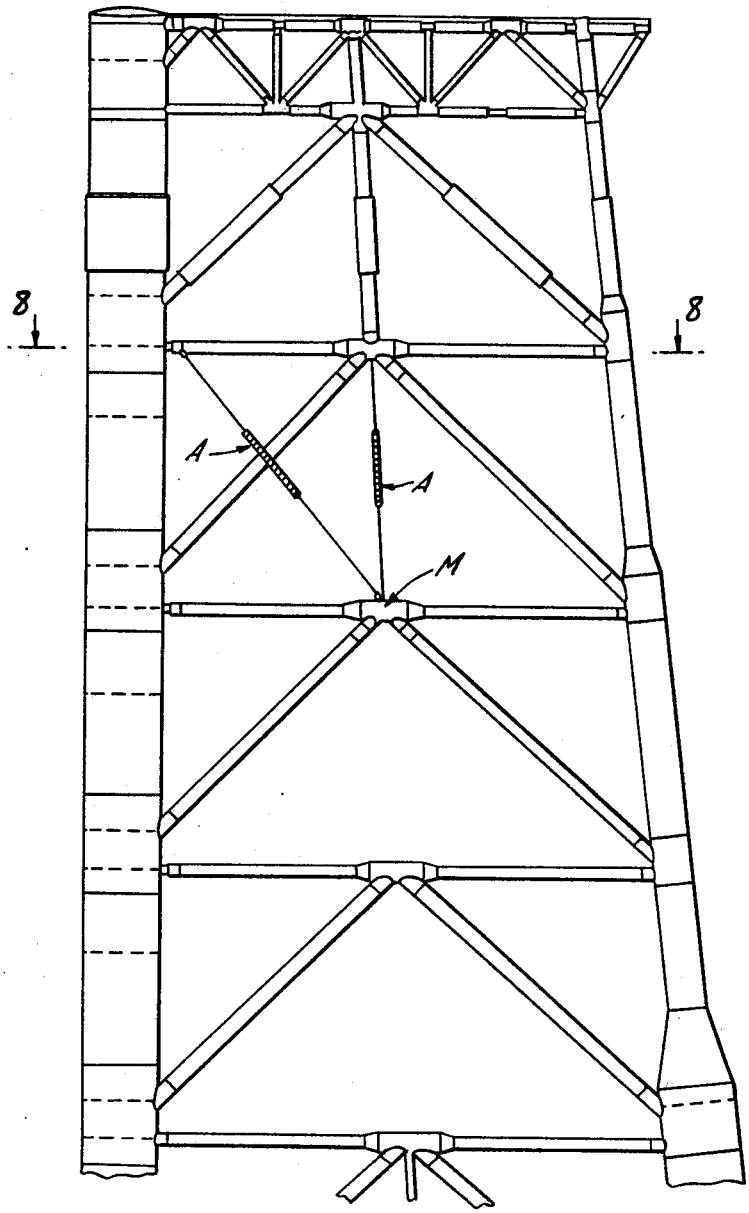
FIG. 7 shows a side view of an oil rig structure which has cathodic protection provided to one level thereof by the incorporation of anode assemblies in accordance with the present invention.
Figure 8:
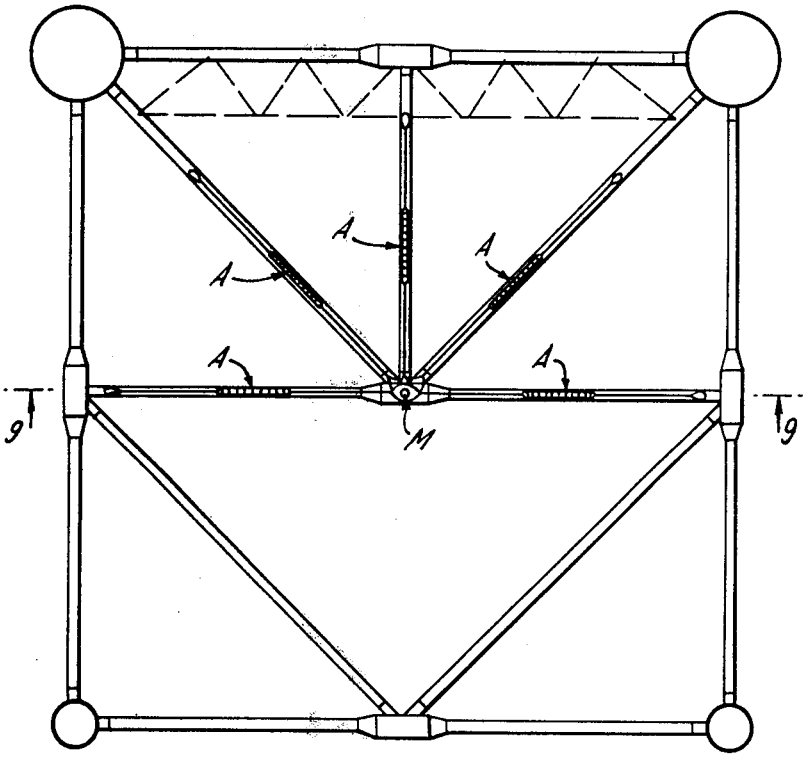
FIG. 8 is a plan view of a section through FIG. 7 looking down from line 7—7.
Figure 9:
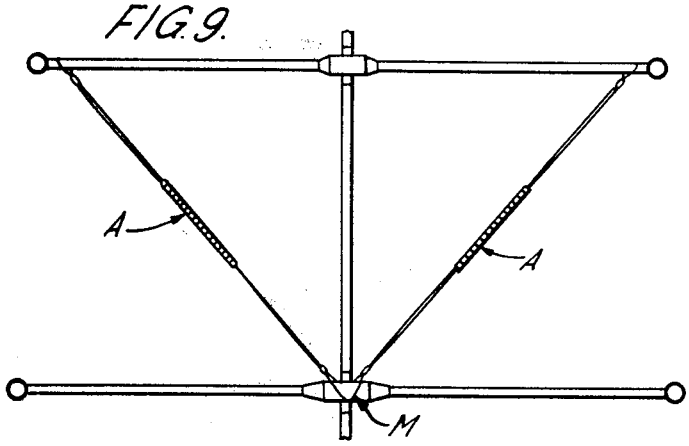
FIG. 9 is a section along line 8—8 of FIG. 8 showing the anode assemblies in the plane of the section only.

Looking now at FIGS. 7, 8 and 9, FIG. 7 shows a side view of an oil rig structure with anode assemblies in accordance with the present invention and designated by reference numeral A fitted into position at a particular level in the rig, each anode assembly A being connected to an interconnecting member M in the centre of the rig. From FIG. 8, it can be seen that there are five anode assemblies arranged in a half conical shape and FIG. 9 shows the fastening arrangement for the two assemblies in the plane of the section indicated by the line 8—8 in FIG. 8.

In installing anode assemblies in accordance with the present invention in, for example, an oil rig structure components such as washers may be made from, for example, an appropriate grade of "Tufnol" and any bolts may be made from titanium which is unaffected by water or electrolytic action.

In general, when considering the use of the present invention to provide cathodic protection for an oil rig structure, all cables for a group of anode assemblies in accordance with the present invention (for example that illustrated in FIGS. 7, 8 and 9) may be taken up to cellar deck level inside a non-metallic hose. The hose may be made of PVC with nylon reinforcement and may be strapped to a convenient vertical member in the oil rig structure. Furthermore, if all the members of a group of anode assemblies have the same cable and electrode lengths they can easily be connected in parallel to one rectifier to provide the necessary DC current. Facilities at an appropriate junction box should allow a clip-on ammeter to be used to check that all anodes are dissipating approximately the same current.

As will be apparent, the disposition of a group of anode assemblies in accordance with the present invention inside a particular structural level of, for example, an oil rig will be, to a large extent, dictated by the arrangement of the members which form the oil rig structure. Within this limitation, the anode assemblies may be arranged so as to satisfy the requirement for cathodic protection loading and current distribution in order to achieve appropriate corrosion resistance for the structure which it is desired to protect.

I claim:

1. A cathodic protection anode assembly comprising a rope having two or more strands helically wound around one another, at least one anodically polarisable material in the form of an elongate member wound helically around the rope and lying in a depression between the strands and being electrically insulated from the rope, and means to connect in use, the anodically polarisable material to a source of electrical current.

2. An assembly as claimed in claim 1 in which there are three or more strands.

3. An assembly as claimed in claim 2 in which there is a plurality of elongate anodically polarisable members.

4. An assembly as claimed in any one of claims 1 to 3 in which the rope is formed of an electrically insulating material.

5. An assembly as claimed in claim 1 in which the rope is provided with at least one shrink fit plastics material sheath, the sheath being shrunk onto the rope and the elongate member (being disposed around and over the sheath.

6. An assembly as claimed in claim 5 in which the sheath is formed of a material resistant to gases generated, in use, at the anodically active elongate material.

7. An assembly as claimed in claim 6 in which the sheath is formed of polyvinylidene fluoride.

8. An assembly as claimed in claim 1 in which the elongate member is formed of titanium, niobium or tantalum with a coating of an anodically active material.

9. An assembly as claimed in claim 8 in which the anodically active material is selected from the group consisting of platinum, iridium, palladium, ruthenium, rhodium or osmium or alloys thereof or oxides or other anodically active compounds thereof.

10. An assembly as claimed in claim 9 in which the elongate members are formed of platinised titanium copper-cored wire.

11. An assembly as claimed in claim 1 in which the strands of the rope are formed from a material selected from the group consisting of polyester or polypropylene.

12. An assembly as claimed in claim 1 in which the elongate member is held in place by further shrink fit sleeves of plastics material.

13. An assembly as claimed in claim 1 in which the rope has a central portion around which the elongate members are wound and two integral end portions wherein the length of each of the end portions is not less than the length of the central portion.

14. A method of cathodically protecting a structure comprising the steps of securing to the structure a cathodic protection anode assembly as claimed in any one of claims 1 to 3, connecting the anodically polarisable material as an anode relative to the structure and passing an electrical current through the anode.

15. A structure provided with a cathodic protection anode assembly as claimed in any one of claims 1 to 3.

* * * * *